US006376974B1

(12) United States Patent
Tsai

(10) Patent No.: US 6,376,974 B1
(45) Date of Patent: Apr. 23, 2002

(54) LAMP STRUCTURE FOR LAMP STRINGS

(76) Inventor: Ching-Yen Tsai, No. 63, Cheng-Kung Road, Hsinchu City (TW)

( * ) Notice: Subject to any disclaimer, the term of this patent is extended or adjusted under 35 U.S.C. 154(b) by 0 days.

(21) Appl. No.: 09/569,442

(22) Filed: May 12, 2000

(51) Int. Cl.[7] ..... H01J 5/54; H01R 33/00

(52) U.S. Cl. ..... 313/318.01; 313/318.05; 313/318.09; 362/226; 439/619

(58) Field of Search ..... 313/318.09, 318.01, 313/318.05, 318.12; 362/226, 238, 441, 389, 806; 439/619, 375

(56) References Cited

U.S. PATENT DOCUMENTS 5,498,922 A * 3/1996 Chang ..... 313/318.1
5,701,051 A * 12/1997 Lin ..... 362/226 X
6,043,594 A * 3/2000 Huang ..... 313/318.09

* cited by examiner

*Primary Examiner*—Ashok Patel

(57) ABSTRACT

An improved lamp structure for lamp strings comprising a lamp bulb, a base, a socket and two conductors is disclosed. The base is provided therein with a receiving recess and has a lower portion thereof partially opened, so that when the lamp bulb is placed in the base, the lower end the lamp bulb is partially exposed. The socket is provided therein with pairs of ribs; they can forcedly press the base and the lamp bulb to fix their positions, and form an engaging groove to receive the metallic pins of the conductors. By this arrangement, the metallic pins of the conductors can electrically contact respectively two metallic wires of the lamp bulb. Therefore, the longitudinal size of the elements of the whole structure can be shortened to reduce cost of material in production, and thereby safety of the products can be elevated.

8 Claims, 5 Drawing Sheets

LAMP STRUCTURE FOR LAMP STRINGS

BACKGROUND OF THE INVENTION

1. Field of the Invention

The present invention is related to an improved lamp structure for lamp strings, and especially to a lamp structure of which the longitudinal size is reduced, the lamp can be firmly set therein. Thereby, cost of production thereof can be lowered, and safety of use thereof can be increased.

2. Description of the Prior Art

As shown in FIG. 1 which shows an analytic perspective view of a conventional lamp structure, the lamp structure is comprised of a lamp bulb 1, a base 2, a socket 3 and two conductors 4. The lamp bulb 1 is provided on the lower end thereof with two metallic wires 11. The base 2 is provided therein with a receiving recess 21 to receive the lamp bulb 1 therein; the receiving recess 21 of the base 2 is divided into an upper portion and a lower portion. The upper portion is formed from a cylindrical wall of a main body 20, so that a cylindrical space is formed therein to receive the lamp bulb 1; the inner diameter of the receiving recess 21 is coincident with the external diameter of the lamp bulb 1. The lower portion of the receiving recess 21 is made as a rectangular hollow connecting portion 22 with a through hole on the bottom thereof (not shown) for extending therethrough the two metallic wires 11. In assembling, the two metallic wires 11 extend through the through hole to the outside of the base 2. The socket 3 is a hollow body with a receiving space 31 of which the upper portion has a larger space for insertion therein of the base 2 and of which the lower portion has a smaller space for insertion therein the two conductors 4 from below. Two metallic pieces 41 on the two conductors 4 are fixed in an engaging groove (not shown) in the socket 3. Thereby, when in insertion of the base 2, the metallic pieces 41 on the two conductors 4 can contact the two metallic wires 11 of the lamp bulb 1 to form a complete electric loop. However, such structure has the following defects:

1. In manufacturing lamp bulbs, it is unable to make every lamp bulb have same external diameter, difference of external diameters of them renders part of the smaller lamp bulbs to be subjected to being rotated by external force when the latter are placed in receiving the recesses 21 of bases 2. The metallic wires 11 beneath them thereby contact with each other to form short circuit, and a latent danger exists.
2. The bases 2 and the sockets 3 have larger lengths, they need more material for manufacturing; this results higher cost.
3. The metallic wires 11 of the lamp bulbs 1 have larger lengths which are at least 10 mm, this also results higher cost.
4. The lower portions of the bases 2 are subjected to water accumulating, and subjected to getting short circuit.
5. The bases 2 have larger depths, when in assembling, the metallic wires 11 of the lamp bulbs 1 are hard to align with the through holes on the bottoms of the bases 2 when they are to extend through the through holes, and such work is time consumptive.

SUMMARY OF THE INVENTION

In view of this, the main object of the present invention is to provide an improved lamp structure for lamp strings, the structure can have its longitudinal size reduced, and cost of production thereof can be lowered. That is, the longitudinal size of the base thereof is reduced; and correspondingly the longitudinal size of the socket is reduced, the length of the metallic wires 11 is shortened, thus cost of production can be largely reduced.

The secondary object of the present invention is to provide an improved lamp structure for lamp strings of which the lamp bulb is not subjected to being rotated. The bottom portion of the lamp bulb is completely set in the base to diminish space for rotation, and a plurality of ribs are provided in the socket to tightly abut against the external bottom portion of the lamp bulb, thereby, the lamp bulb is not subjected to being rotated by external force and safety of use thereof can be increased.

Another object of the present invention is to provide an improved lamp structure for lamp strings which is easy for assembling. Wherein, the longitudinal size of the socket is reduced, and the lower portion of the socket is partially opened, insertion of the metallic pins of the lamp bulb is more convenient and quicker.

Another object of the present invention is to provide an improved lamp structure for lamp strings which is not subjected to water accumulation. By virtue that the base thereof is shortened, and the bottom portion of the lamp bulb is completely set in the base, there is no space for water accumulation, and it is safer for use.

The present invention will be apparent in its particularity and technical contents after reading the detailed description of the preferred embodiment thereof in reference to the accompanying drawings.

DETAILED DESCRIPTION OF THE PREFERRED EMBODIMENT

Figure 1:
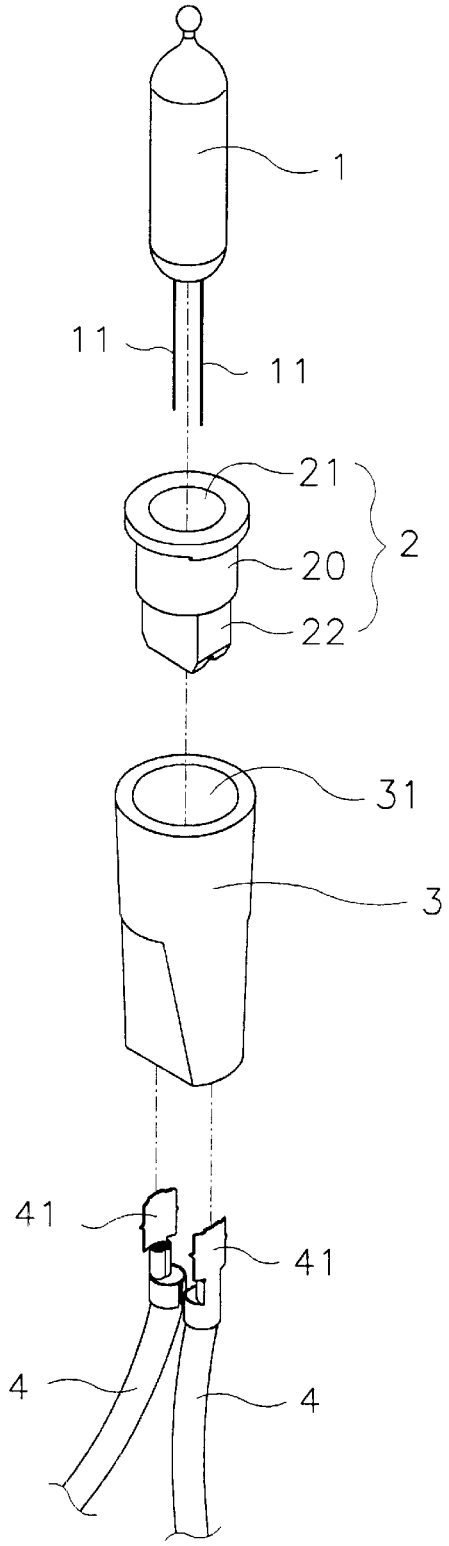
Fig. 1 Prior Art
FIG. 1 is an analytic perspective view of a conventional lamp structure for lamp strings.
Figure 2:
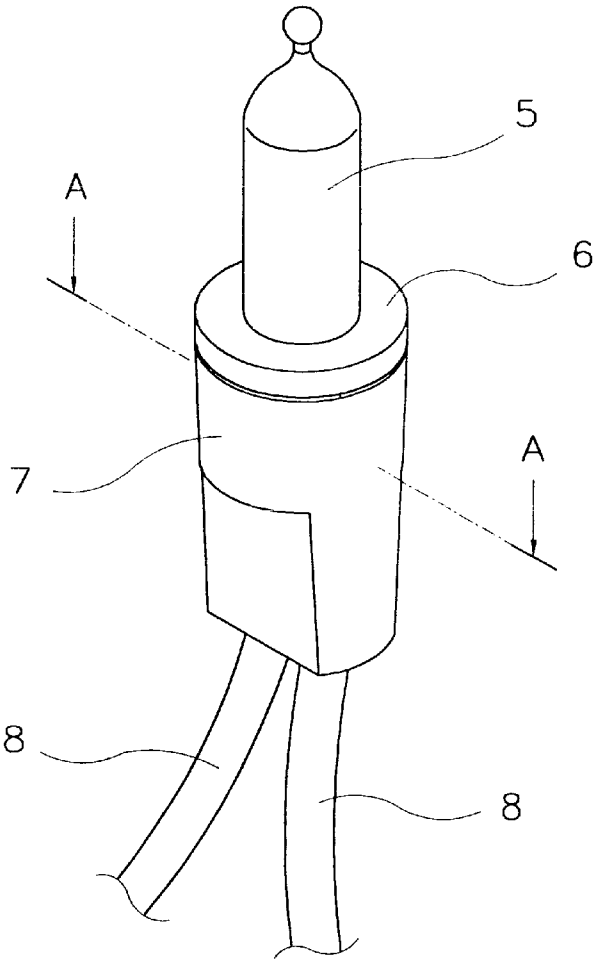
FIG. 2 is a perspective view showing the lamp structure for lamp strings of the present invention.
Figure 3:
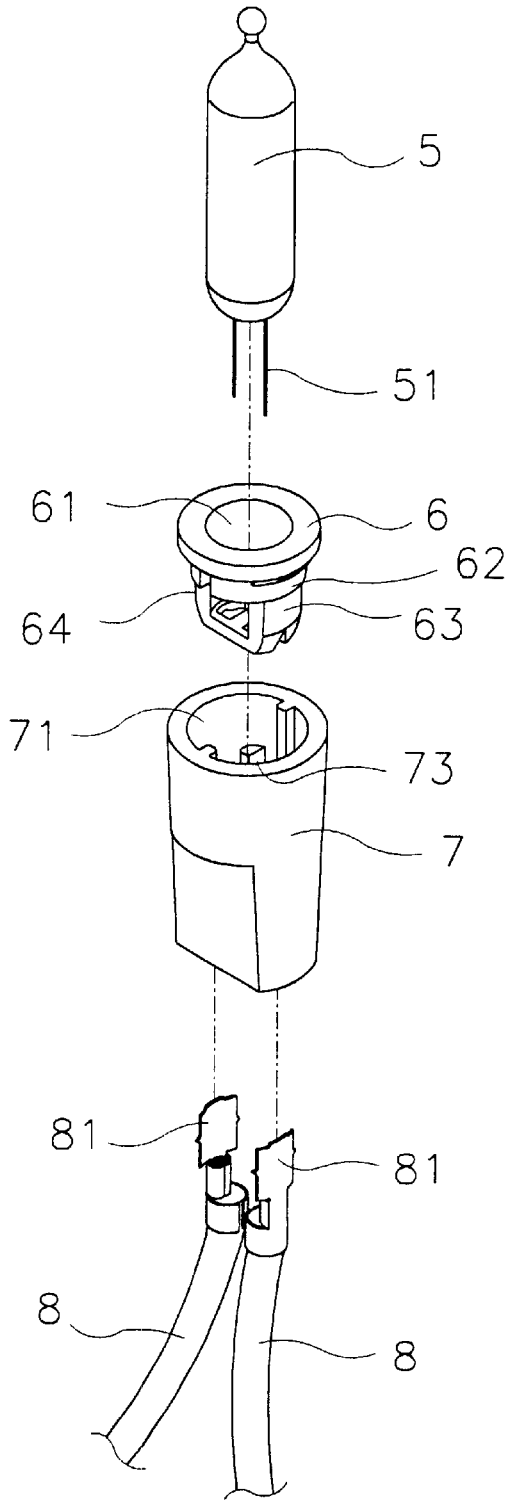
FIG. 3 is an analytic perspective view of the present invention.

Referring to FIGS. 2 and 3 which are respectively a perspective view and an analytic perspective view of the improved lamp structure for lamp strings of the present invention, wherein, the present invention is comprised of the main members of a lamp bulb 5, a base 6, a socket 7 and two conductors 8. The lamp bulb 5 is placed with the lower end thereof in the base 6, while the latter is in turn placed in the socket 7, two metallic pins 81 of the two conductors 8 are also engaged in the socket 7; so that the two metallic pins 81 of the two conductors 8 contact respectively with two metallic wires 51 of the lamp bulb 5 to form a complete electric loop. In the present invention, the main improvements are that, the longitudinal size of the base 6 is reduced to about ⅔of a conventional one; and the lower portion of the base 6 is partially opened, so that when the lamp bulb 5 is placed in the base 6, the lower end the lamp bulb 5 is partially exposed. The socket 7 is provided therein with a plurality of ribs 73; they can forcedly press the base 6 and the lamp bulb 5 to fix their positions, and form an engaging groove to receive the metallic pins 81 of the conductors 8. By this arrangement, the metallic pins 81 of the conductors 8 can contact respectively with two metallic wires 51 of the lamp bulb 5. Therefore, the longitudinal size of the elements of the whole structure, such as the base 6, the socket 7 and the two metallic wires 51 beneath the lamp bulb 5 can be shortened to reduce cost of material in production, and thereby safety of the products can be elevated.

The structure and connection of the elements of the present invention are now described in details as below:

The lamp bulb 5 is a lamp bulb with tungsten filament, two metallic wires 51 are extended downwards therefrom; length of the metallic wires 51 is preferably within the range of 5–8.5 mm.

Figure 4:
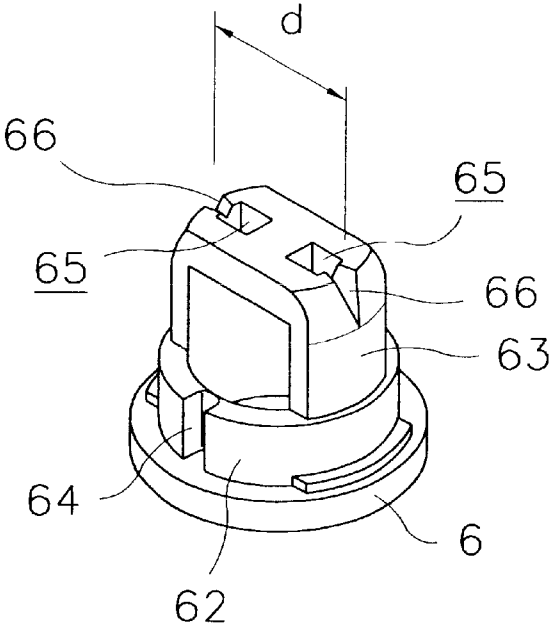
FIG. 4 is a perspective view showing another aspect of the present invention.
Figure 7:
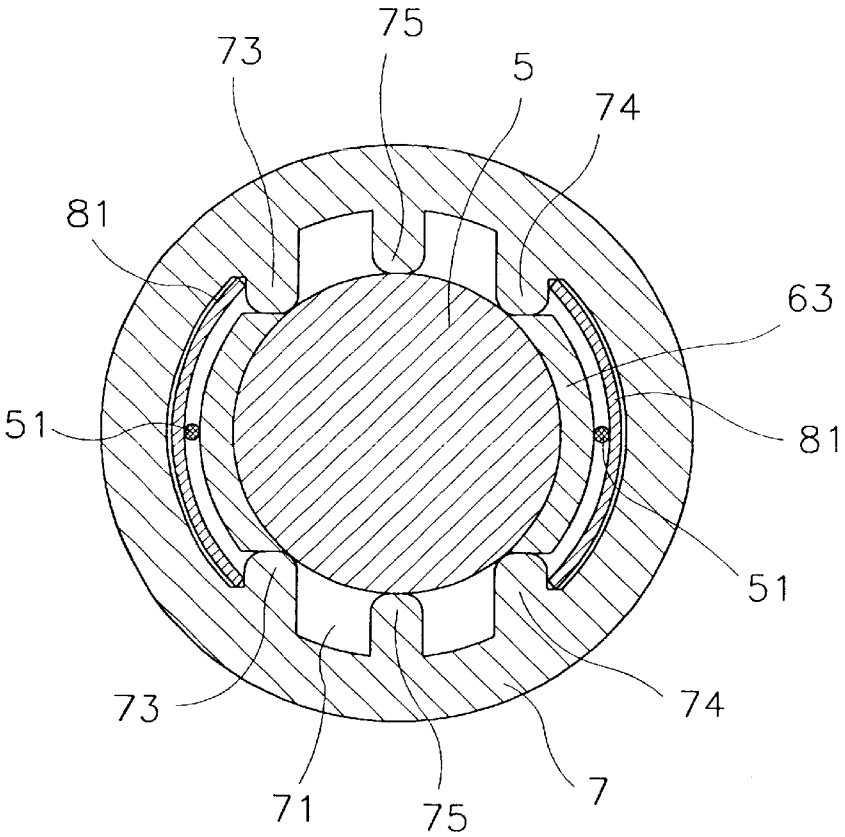
FIG. 7 is a sectional view taken from A—A sectional line of FIG. 2.

Referring to FIGS. 3 and 4, the base 6 is a hollow body, the longitudinal size thereof is only within the range of 6–10 mm; a receiving recess 61 is provided therein, preferably a cylindrical space is formed in the receiving recess 61 to receive therein the lamp bulb 5. The lamp bulb 5 is placed with the lower end thereof in the base 6. The receiving recess 61 is formed from an upper portion that is a cylindrical wall 62 and a lower portion that is a connecting portion 63 of the base 6. The cylindrical wall 62 has a larger diameter, and is used mainly for mating with a receiving space 71 of the socket 7; the cylindrical wall 62 is provided mutually oppositely with two vertical grooves 64. The connecting portion 63 on the lower portion of the base 6 is a "U" shaped member, it is narrower in width, so that the lower portion of the receiving recess 61 is left two partially opened spaces. When the lamp bulb 5 is placed in, the lower end the lamp bulb 5 is partially exposed. The transverse size "d" of the receiving recess 61 is smaller than the inner diameter of the receiving space 71 of the socket 7, when in assembling, there are gaps between both the lateral sides of the connecting portion 63 and the receiving space 71 (as shown in FIG. 7), in order that the metallic pins 81 of the conductors 8 and the two metallic wires 51 of the lamp bulb 5 can be placed therebetween to contact mutually. The connecting portion 63 is further provided on the bottom thereof with two through holes 65 to permit extending of the two metallic wires 51 of the lamp bulb 5 therethrough to the outside of the base 6; and two "V" shaped guiding grooves 66 are provided between the two lateral sides at the bottom of the connecting portion 63 and the two through holes 65 for bending of the two metallic wires 51 toward the lateral sides.

Figure 5:
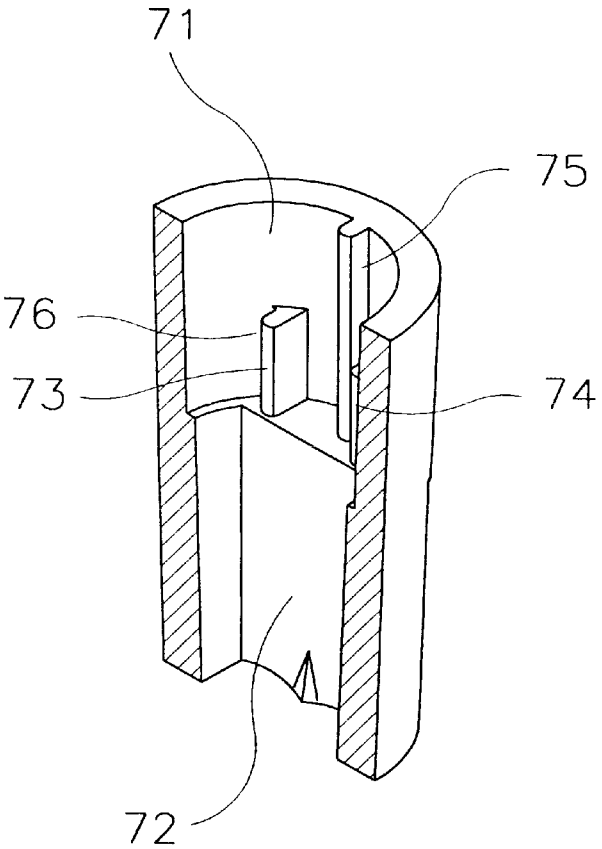
FIG. 5 is a sectional schematic view of the socket of the present invention.
Figure 6:
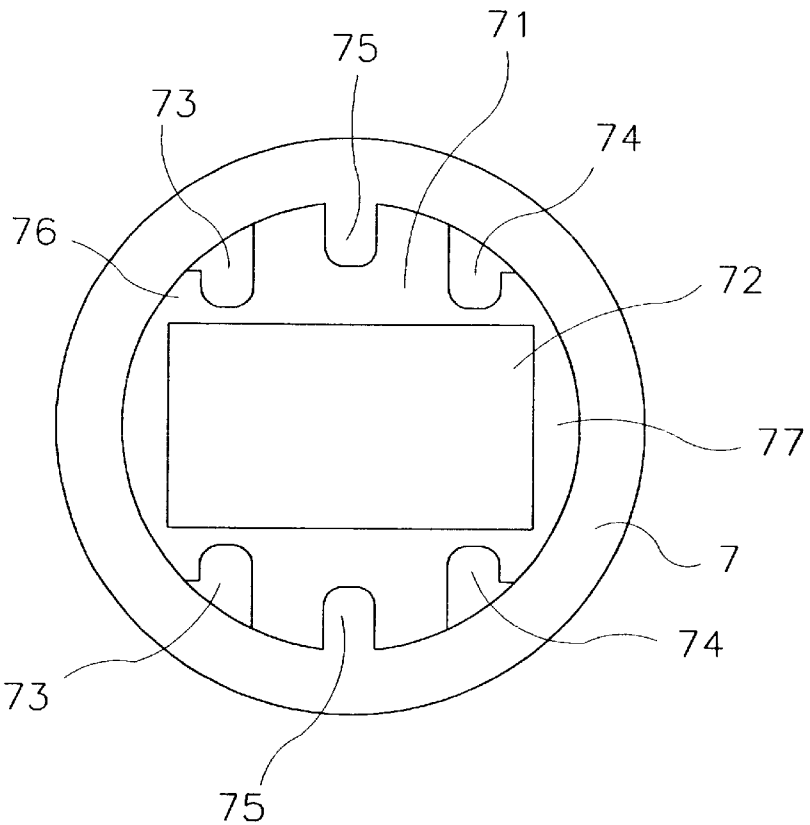
FIG. 6 is a top view of the socket of the present invention.

Referring to FIGS. 3, 5 and 6, the longitudinal size of the socket 7 is within the range of 14–16.5 mm. The socket 7 is provided therein with a space of which the upper portion is larger and forms the receiving space 71 for receiving therein the base 6, while the lower portion is tapered and forms a flat conductor groove 72 to receive therein the two conductors 8. The flat conductor groove 72 can be rectangular (as shown in FIG. 5), and can also be in the shape of "8" in similarity to the shape of the two conductors 8. Pairs of ribs 73, 74 and 75 are provided on the bottom portion of the receiving space 71, wherein, the ribs 73, 74 are located near the ends of the two widest lateral sides of the flat conductor groove 72 and form respectively engaging grooves 76, 77 together with the wall of the receiving space 71, in order to receive therein the metallic pins 81 of the two conductors 8. The distances between every pair of protrusions of the ribs 73, 74 equal to the width of the connecting portion 63 of the base 6, and allow the ribs 73, 74 to abut against the four corners of the connecting portion 63 when in assembling, so that the position of the base 6 can be fixed. Another pair of ribs 75 are located near the middle of the two lateral sides of the flat conductor groove 72 and extend to the top of the latter, protrusions of the ribs 75 face to the exposed portions at the lower end the lamp bulb 5 (as shown in FIG. 7). When in assembling, the ribs 75 forcedly press the lower end of the lamp bulb 5, while the ribs 73, 74 also partially press the lower end of the lamp bulb 5. By the six forces exerted on the lower end of the lamp bulb 5 (such as by pressure of the ribs 73, 74 and 75 and the cylindrical wall 62), it is uneasy to rotate the lamp bulb 5; hence safety of use can be increased. The ribs 75 extend upwardly to the top of the socket 7, they engage the two vertical grooves 64 on the cylindrical wall 62 of the base 6 in assembling. The ribs 75 extending upwardly to the top of the socket 7 not only can effectively preventing rotation of the base 6, but also can prevent kids from extending their fingers into the areas to be electrically shocked due to the fact that it only has very small openings.

The conductors 8 are provided each with a metallic pin 81 on one end thereof, and can be inserted into the flat conductor groove 72 on the lower portion of the socket 7, the metallic pins 81 can be engaged in the corresponding engaging grooves 76, 77. When the base 6 is placed in the receiving space 71 of the socket 7, the metallic wires 51 of the lamp bulb 5 contact the metallic pins 81 to complete a circuit loop.

In conclusion, the improved lamp structure for lamp strings of the present invention has the longitudinal size of the base thereof reduced, and has the lower portion of the base partially opened, it can largely reduce cost of material in production. The longitudinal size of the base is reduced, and correspondingly the longitudinal size of the socket is reduced, the length of the metallic wires is shortened, thus cost of production can be further largely reduced. And more, the lower end of the lamp bulb 5 is completely received in the base 6, hence there is no space to allow rotation thereof; plus the condition that the ribs 73, 74 and 75 of the socket 7 press the lower end of the lamp bulb 5 tightly, the latter is further effectively prevented from rotation; thus safety of use can be increased. The improved lamp structure for lamp strings of the present invention thereby is practical, inventive and competitive in the markets.

The above statement is only for illustrating a preferred embodiment of the present invention, and not for giving any limitation to the scope of the present invention. It will be apparent to those skilled in this art that all equivalent modifications and changes shall fall within the scope of the appended claims and are intended to form part of this invention.

What is claimed is:

1. An improved lamp structure for lamp strings comprising: a lamp bulb, having two metallic wires extending downwards therefrom; a base, with a receiving recess provided therein to receive said lamp bulb, said receiving recess is formed from an upper portion that is a cylindrical wall and a lower portion that is a connecting portion of said base, said connecting portion on said lower portion of said base is a "U" shaped member having a narrower width to render a lower portion of said receiving recess to leave two partially opened spaces, said connecting portion is further provided on the bottom thereof with two through holes to permit extending of said two metallic wires of said lamp bulb therethrough for bending of said two metallic wires laterally; a lamp socket, being provided therein with a space of which the upper portion forms a receiving space for receiving therein said base, and of which the lower portion is tapered and forms a flat conductor groove, pairs of ribs are provided in said receiving space, wherein, at least two pairs of said ribs form engaging grooves together with the wall of said receiving space; two conductors, being provided on the ends thereof with metallic pins, said metallic pins are inserted into said flat conductor groove on the lower portion of said socket and being engaged in said engaging grooves, and contact said metallic wires of said lamp bulb.

2. An improved lamp structure for lamp strings as in claim 1, wherein, transverse size of said receiving recess of said base is smaller than the inner diameter of said receiving space of said socket, hence there are gaps between both lateral sides of said connecting portion and said receiving space, in order that said metallic pins of said conductors and said metallic wires of said lamp bulb are placed therebetween.

3. An improved lamp structure for lamp strings as in claim 1, wherein, said at least two pairs of said ribs provided in said receiving space are located near the ends of the two widest lateral sides of said flat conductor groove, the distances between every pair of protrusions of said two pairs of ribs equal to the width of said connecting portion of said base, this allows said ribs to abut against the four corners of said connecting portion.

4. An improved lamp structure for lamp strings as in claim 1, wherein, another pair of said pairs of ribs are located near the middle of the two lateral sides of said flat conductor groove and extend to the top of said flat conductor groove, said another pair of ribs have protrusions facing to exposed portions at the lover end of said lamp bulb, said another pair of ribs forcedly press said lower end of said lamp bulb.

5. An improved lamp structure for lamp strings as in claim 1, wherein, two vertical grooves are provided on said cylindrical wall of said upper portion of said base, said vertical grooves respectively engage another pair of said pairs of ribs extending upwardly to the top of said socket.

6. An improved lamp structure for lamp strings as in claim 1, wherein, length of said metallic wires extending downwardly from said lamp bulb is within the range of 5–8.5 mm.

7. An improved lamp structure for lamp strings as in claim 1, wherein, length of the longitudinal size of said base is within the range of 6–10 mm.

8. An improved lamp structure for lamp strings as in claim 1, wherein, the longitudinal size of said socket is within the range of 14–16.5 mm.

* * * * *